US005819369A

United States Patent [19]

Falvo et al.

[11] Patent Number: 5,819,369

[45] Date of Patent: Oct. 13, 1998

[54] HAND HELD INSITU REACTOR VESSEL STUD CLEANER

[75] Inventors: Gregory E. Falvo, Enfield; Michael J. Linden, Weathersfield; David L. Sibiga, Ashford, all of Conn.

[73] Assignee: Combustion Engineering, Inc., Windsor, Conn.

[21] Appl. No.: 724,386

[22] Filed: Oct. 1, 1996

[51] Int. Cl.[6] ..... B08B 1/04

[52] U.S. Cl. ..... 15/344; 15/22.1; 15/88; 15/104.04

[58] Field of Search ..... 15/22.1, 104.04, 15/88, 344

[56] References Cited

U.S. PATENT DOCUMENTS

| | | | |
|---|---|---|---|
| 2,659,157 | 11/1953 | Aller . | |
| 2,751,617 | 6/1956 | McLaggan . | |
| 3,457,576 | 7/1969 | Yarrow | 15/88 X |
| 3,820,184 | 6/1974 | Stone | 15/104.04 |
| 4,081,325 | 3/1978 | Aubert . | |
| 4,165,549 | 8/1979 | Wennerstrom et al. | 15/88 |
| 4,372,003 | 2/1983 | Toelke | 15/88 |
| 4,433,448 | 2/1984 | True | 15/22.1 X |
| 4,452,753 | 6/1984 | Wentzell et al. . | |
| 4,467,489 | 8/1984 | Begneaud | 15/22.1 X |
| 4,609,311 | 9/1986 | Pettyjohn . | |
| 4,630,410 | 12/1986 | Cavada et al. . | |
| 4,675,967 | 6/1987 | Okada . | |
| 4,722,122 | 2/1988 | Overbay . | |
| 5,005,244 | 4/1991 | Muraguchi | 15/22.1 X |
| 5,309,490 | 5/1994 | Bayersten . | |

FOREIGN PATENT DOCUMENTS

| | | | |
|---|---|---|---|
| 2430822 | 3/1980 | France | 15/104.04 |
| 5-104068 | 4/1993 | Japan | 15/104.04 |

*Primary Examiner*—Mark Spisich
*Attorney, Agent, or Firm*—John H. Mulholland

[57] ABSTRACT

A hand held insitu reactor vessel stud cleaner includes a right angle drill having a frame with an annular ring portion mounted thereon. An annular rotating plate assembly with a cylindrical brush holder or thread chase is concentrically mounted thereon and driven by a spur gear and ring gear combination or a belt and pulley combination. Vacuum structure is provided to remove corroded material loosened by the brushes or chase.

4 Claims, 3 Drawing Sheets

HAND HELD INSITU REACTOR VESSEL STUD CLEANER

BACKGROUND OF THE INVENTION

Nuclear reactor vessels have an upper flanged surface upon which a vessel reactor head is mounted and secured by means of a plurality of threaded studs. The joint or parting line between the flange and the head is part of the pressure boundary and therefor the studs have nuts which secure the vessel and head for operation. The head is necessarily removed during refueling outages, maintenance on the reactor internals and other maintenance operations.

The reactor vessel studs need to be properly cleaned before the nuts can be removed. This is because corrosion of the threads naturally occurs during the reactors' periods of operation. The corrosion is, to some degree, radioactive and so is the environment in which the maintenance operators must work. Accordingly, the minimization of cleaning time is highly desirable.

SUMMARY OF THE INVENTION

The present invention relates to a hand held device for cleaning threaded studs insitu quickly and efficiently in order to save time and personnel radiation exposure.

U. S. Pat. No. 5,309,490 for a REMOTE STUD CLEANER, and assigned to the same assignee as the present invention, requires a motor driven brush unit having lifting means for attaching the device to a crane or hoist. It is not hand held and therefor cannot be as quickly used as the present invention. Moreover, the previously patented device did not contemplate installation of a thread chase as does the present invention.

The new stud cleaner can be used with the nut either on or off the stud. It may also be attached to a vacuum system to minimize the spread of radioactive contamination.

The new stud cleaner may include a frame and bearing mounted rotational unit to be mounted on a hand held ½ inch right angle drill such as that known in the art as Milwaukee Model No. 1107-1. This arrangement provides for a simple, low cost alternative to cleaning the studs by hand or with a wire brush. It also accommodates a thread chase unit to finish the threads for smooth running of a nut therealong.

DETAILED DESCRIPTION OF THE PREFERRED EMBODIMENTS

Figure 1:
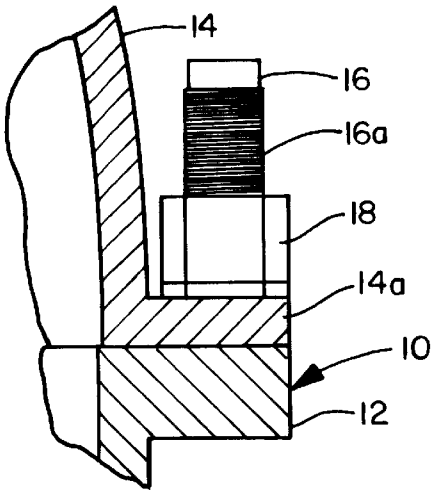
FIG. 1 is a fragmentary elevational view of a domed head on a reactor pressure vessel and a threaded stud with nut securing them together.
Figure 2:
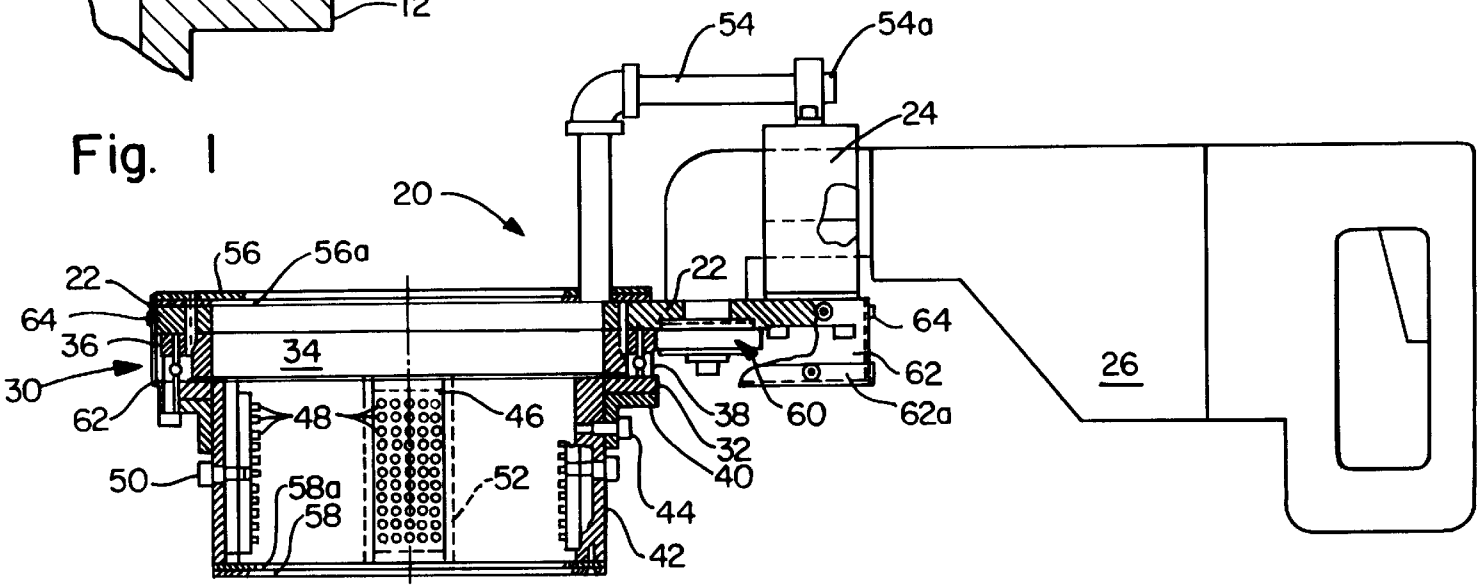
FIG. 2 is a side elevational view of the device of the invention with the thread cleaning brush holder and brushes in place with portions broken away to show cross-sections of certain of the parts.
Figure 3:
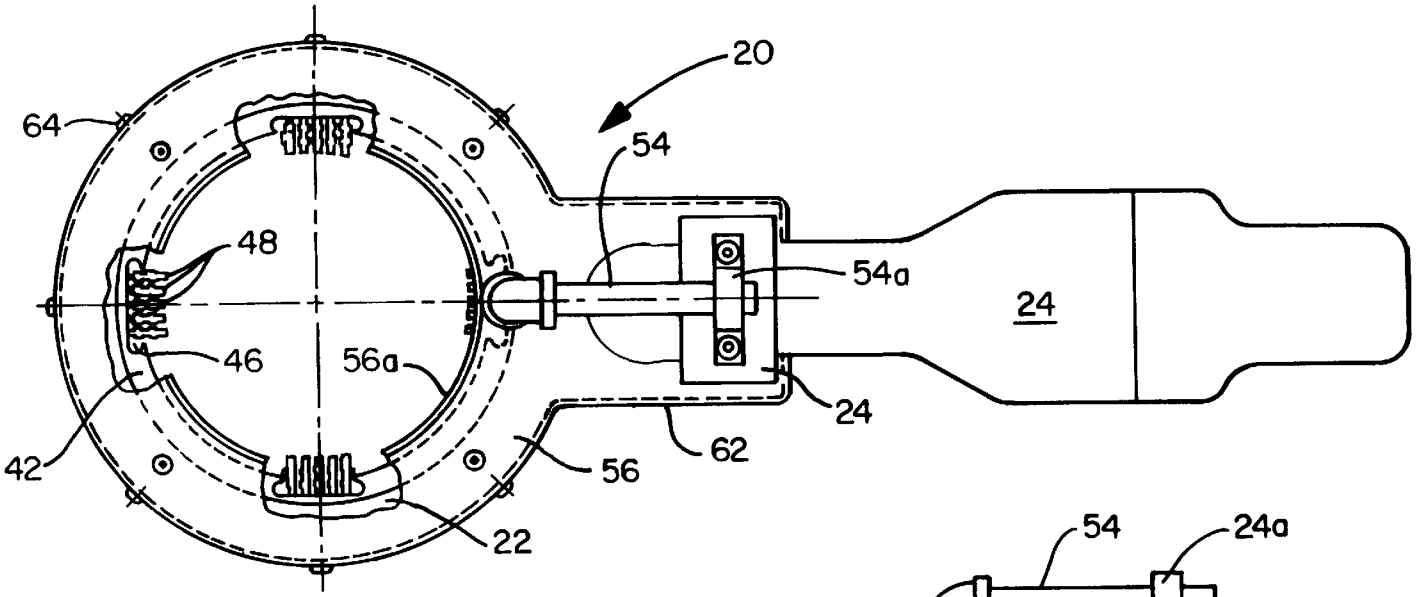
FIG. 3 is a top plan view of the device of FIG. 2.

In FIG. 1, the numeral 10 generally designates a portion of a nuclear reactor pressure vessel having a flange 12, a domed head 14 and flange 14*a* for mating in secured and pressure tight relation with flange 12. The flanges 12 and 14*a* are secured by means of a stud 16 having threads 16*a* exteriorly thereof and nut 18.

The threads 16*a* are exposed to environmental factors which create radioactive corrosion thereon. This corrosion has to be removed to enable the nuts to move along the threads.

The numeral 20 generally designates the hand held insitu reactor vessel stud cleaner of the invention. Stud cleaner 20 is an assembly which includes a frame 22, made conveniently of aluminum, which is attached by means of a clamp 24 to a ½ inch right angle drill 26.

An annular rotating plate assembly, generally designated by the numeral 30, and including: a rotating plate 32, a bearing holder 34, a ring gear 36 and a roller bearing 38 is bolted to the underside of a generally annular ring shaped portion of frame 22 in concentric relation therewith.

Below, concentric with and adjacent the rotating plate assembly 30 and bolted to rotating plate 32 is an annular attachment ring 40 to which the cylindrical brush holder 42 is concentrically attached by means of bolts 44.

Within the brush holder 42 are brush shoes 46 which contain groups of stainless steel bristles 48 of progressively larger size both circumferentially away from the center of the brush shoes 46 and as the corroded threads advance into brush holder 42. Bolts 50 hold the brush shoes 46 in channels 52 which run parallel to the axis of brush holder 42.

To provide vacuuming of the radioactively contaminated corrosion material, a pipe assembly 54 is clamped on clamp 24 by means of clamp 24*a* and runs from its exterior vacuum line connection end 54*a* to a point within the ring shaped portion of frame 22 where it communicates with a chamber defined by the inner surfaces of the ring shaped portion, rotating plate assembly 30 and the cylindrical brush holder 42. A top vacuum plate 56 with gasket 56*a* and a bottom vacuum plate 58 and gasket 58*a* make up a closed chamber when a stud 16 is being cleaned.

The brush holder 42 and therefor the brushes are rotated by means of a spur gear 60 in toothed engagement with ring gear 36. These are suitably driven by drill 26. Instead of the spur and ring gear drive, a belt drive can be utilized with a belt rotating, instead of the ring gear, as it is driven from a pulley, instead of the spur gear. A frame skirt 62 and cover 62*a* enclosed the moving drive parts in both cased and is held in place by bolts 64.

Figure 4:
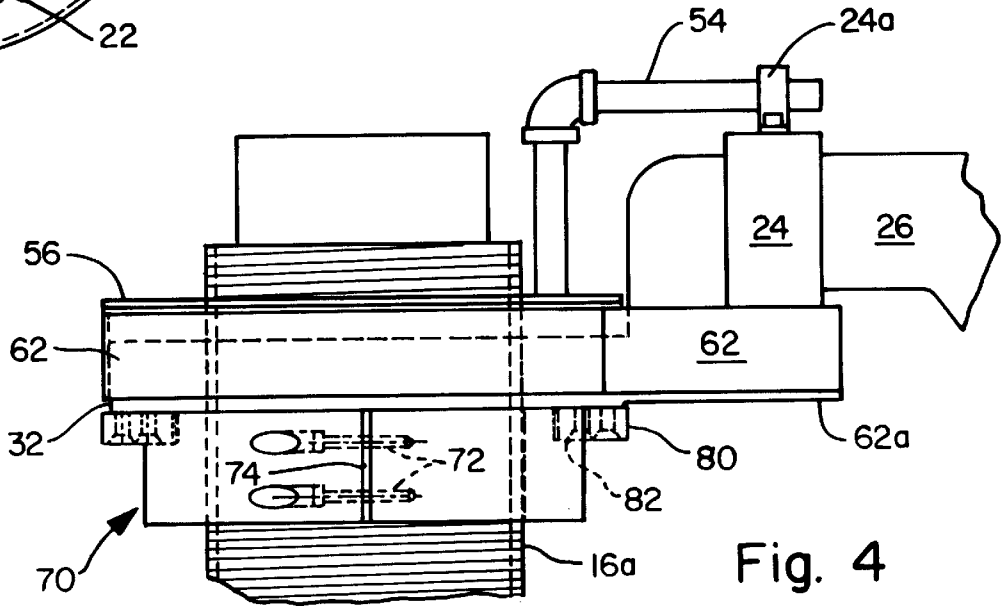
FIG. 4 is a side elevational view of the device of FIGS. 2 and 3 with a thread chase instead of a brush holder and brushes in position for rotation.
Figure 7:
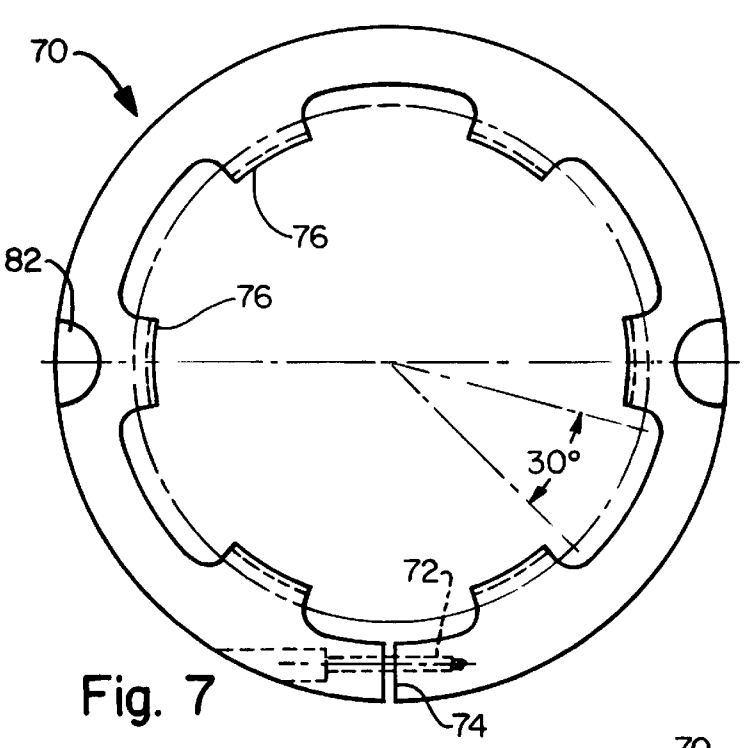
FIG. 7 is a top plan view of the thread chase for use in the device.
Figure 8:
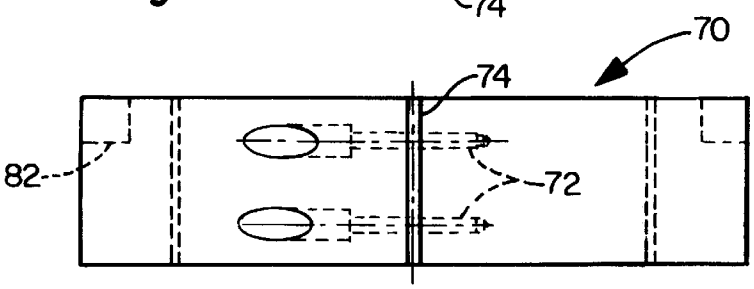
FIG. 8 is a side elevational view of the thread chase of FIG. 7.
Figure 5:
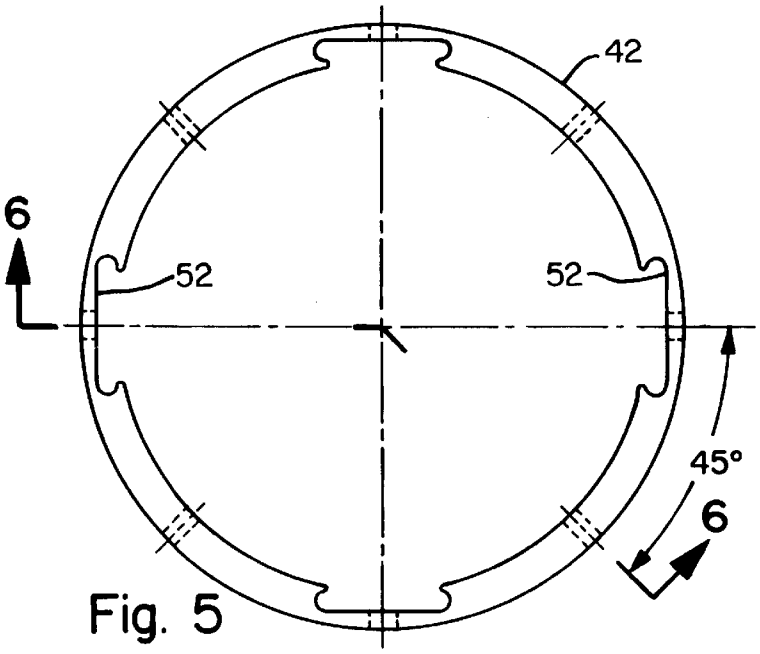
FIG. 5 is a top plan view of the brush holder for use in the device.
Figure 6:
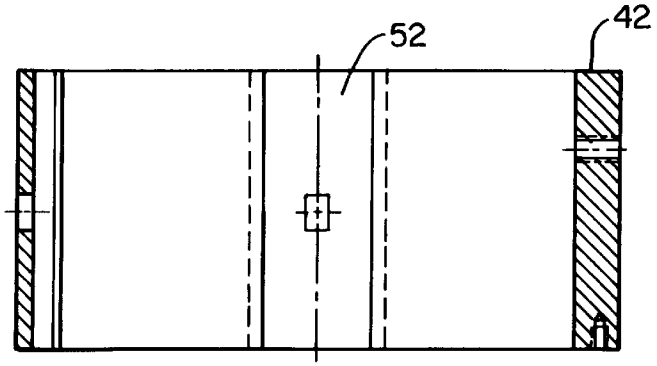
FIG. 6 is a cross-sectional elevational view of the brush holder taken along line 5—5 of FIG. 5.

As seen in FIG. 4, the stud cleaner 20, with brush holder 42, attachment ring 40, bottom vacuum plate 58 and gasket 58*a*, removed, can receive a cylindrical thread chase unit 70.

The thread chase unit 70 is preferably made of Delrin plastic and includes key locking threaded inserts 72 which can lock the chase on the threads 16*a* of stand 16 because of a saw cut 74. The thread engaging portions 76 of the chase work to finish clean burrs, etc. from the threads. The vacuum may be used during this operation in the same manner as during the brushing operation.

To drive the thread chase 70, aluminum drive tabs 80 are bolted to rotating plate 32. With thread chase 70 on the threads 16*a*, tabs 80 fit into recesses 82 of the chase 70 and are driven thereby.

We claim:

1. A hand held insitu reactor vessel stud cleaner which includes in combination:

a drill having a rotary drive means;

a frame having an annular ring portion;

an annular rotating plate assembly mounted on the frame concentrically with said ring portion;

a cylindrical brush holder and brushes open at one end to receive a threaded stud for cleaning;

means for attaching said brush holder to said rotating plate assembly;

and driving means the annular rotating plate assembly and cylindrical brush holder attached thereto.

2. The hand held insitu reactor vessel stud cleaner of claim 1 in which the drill is a right angle drill.

3. The hand held insitu reactor vessel stud cleaner of claim 1 in which the brush holder and its means for attaching it to the rotating plate assembly are removable for attachment thereto of means to engage and drive a cylindrical thread chase.

4. The hand held insitu reactor vessel stud cleaner of claim 1 in which a vacuum tube is attached to a chamber defined by the frame annular ring portion, the annular rotating plate assembly and the cylindrical rotating member.

* * * * *